US010625516B2

(12) United States Patent
Iioka et al.

(10) Patent No.: US 10,625,516 B2
(45) Date of Patent: Apr. 21, 2020

(54) PRINTING METHOD

(71) Applicant: WinClass Co., Ltd., Soka-shi (JP)

(72) Inventors: Katsumasa Iioka, Misato (JP); Miyuki Oke, Soka (JP); Kenji Taminami, Koshigaya (JP)

(73) Assignee: WINCLASS CO., LTD., Soka-Shi (JP)

( * ) Notice: Subject to any disclaimer, the term of this patent is extended or adjusted under 35 U.S.C. 154(b) by 0 days.

(21) Appl. No.: 16/291,150

(22) Filed: Mar. 4, 2019

(65) Prior Publication Data

US 2020/0070542 A1 Mar. 5, 2020

(30) Foreign Application Priority Data

Aug. 28, 2018 (JP) ..... 2018-158830

(51) Int. Cl.

| | |
|---|---|
| ***B41J 2/47*** | (2006.01) |
| ***B41J 2/525*** | (2006.01) |
| ***B41J 2/44*** | (2006.01) |
| ***B41J 2/21*** | (2006.01) |

(52) U.S. Cl.

CPC ..... *B41J 2/473* (2013.01); *B41J 2/2114* (2013.01); *B41J 2/442* (2013.01); *B41J 2/525* (2013.01)

(58) Field of Classification Search

CPC . B41J 2/473; B41J 2/2114; B41J 2/442; B41J 2/525

USPC ..... 347/234

See application file for complete search history.

(56) References Cited

U.S. PATENT DOCUMENTS

| | | | | |
|---|---|---|---|---|
| 6,360,656 | B2 * | 3/2002 | Kubo | B41J 2/01 101/35 |
| 7,561,301 | B2 * | 7/2009 | Osumi | B41J 3/4073 358/1.1 |
| 8,643,899 | B2 * | 2/2014 | Koyama | B41J 3/4073 264/132 |
| 8,675,254 | B2 * | 3/2014 | Fujita | H04N 1/6033 345/419 |
| 9,352,550 | B2 * | 5/2016 | Zhang | B41J 3/00 |
| 2001/0019340 | A1 * | 9/2001 | Kubo | B41J 2/01 347/1 |
| 2017/0087924 | A1 * | 3/2017 | Aihara | B32B 3/085 |
| 2017/0120626 | A1 * | 5/2017 | Allen | B41J 3/32 |

FOREIGN PATENT DOCUMENTS

JP 2013-208845 10/2013

* cited by examiner

*Primary Examiner* — Huan H Tran
*Assistant Examiner* — Alexander D Shenderov
(74) *Attorney, Agent, or Firm* — Lex IP Meister, PLLC

(57) ABSTRACT

A printing method includes an analysis step, which analyses the shape of the three-dimensional surface and position of the printing part of the object to be printed with the three-dimensional surface and converts into two-dimensional data, a placement step, in which at least one part of the object is placed in the placement recess of jig with the three-dimensional surface facing upwards, a primer layer formation step, which forms a primer layer on the printing part based on the two-dimensional data, a white color coating step, which performs UV irradiation after coating white UV curable ink on the surface of the primer layer based on the two-dimensional data, and a color printing step, which performs UV irradiation by coating UV curable ink other than white color on the surface of the printing part on which the white UV curable ink has been coated based on the two-dimensional data.

3 Claims, 5 Drawing Sheets

PRINTING METHOD

CROSS-REFERENCE TO RELATED APPLICATION

This application claims priority of Japanese Patent Application No. 2018-158830 filed on Aug. 28, 2018. The contents of this application are incorporated herein by reference in their entirety.

BACKGROUND OF THE INVENTION

The present invention relates to a printing method for printing on the surface of an object to be printed with a three-dimensional surface.

Conventionally, one of the printing methods for printing on the surface of an object to be printed having a three-dimensional surface, for example, is the printing method described in patent document 1.

According to the printing method described in patent document 1, a three-dimensional surface is formed using a bistable thermochromic material on the surface of the object to be printed, and then the three-dimensional surface is heated by using a laser to develop the color of the bistable thermochromic material.

In addition to such printing methods, printing on a three-dimensional surface of an object to be printed is also performed by various other methods.

Patent Document 1: Unexamined Patent Publication No. 2013-208845

SUMMARY

In the method described in patent document 1, for full-color printing, multiple types of bistable thermochromic material are prepared, and arranged in various patterns, and the color of each dot unit is developed by irradiation of laser. This method of printing in addition to increasing the printing cost and complexity of the printing process, makes the dots conspicuous, and it is difficult to perform full-color printing that is detailed and highly accurate. These problems also occur when other conventional printing methods are used. Therefore, a printing method capable of reducing the printing cost while printing at high speeds, and capable of full-color printing that is detailed and highly accurate has been long-awaited.

The present invention has taken the above-described problems into consideration, and the objective is to provide a printing method capable of full-color printing that is fast, detailed, and highly accurate at a low printing cost on a three-dimensional surface of the object to be printed.

To solve the above problems, the printing method of the present invention, is characterized by comprising of an analysis step, which analyses the shape of the three-dimensional surface and position of the printing part of the object to be printed with the three-dimensional surface that includes the printing part and converts into two-dimensional data, a placement step, in which at least one part of the object to be printed is placed in the placement recess of the jig with the three-dimensional surface facing upwards, a primer layer formation step, which forms a primer layer on the printing part of the three-dimensional surface based on the two-dimensional data, a white color coating step, which performs UV irradiation after coating white UV curable ink on the surface of the primer layer of the printing part based on the two-dimensional data, and a color printing step, which performs UV irradiation by coating UV curable ink other than white color on the surface of the printing part on which the white UV curable ink has been coated based on the two-dimensional data.

According to the printing method of the present invention, full-color printing that is fast, detailed, and highly accurate at a low printing cost on a three-dimensional surface of the object to be printed is possible.

In the above described printing method of the present invention, UV curable ink coated in the color printing step may be UV curable inks of colors yellow, magenta, cyan, and black other than white.

This makes it possible to perform full-color printing with high accuracy.

In the above described printing method of the present invention, in the placement step, positioning into the placement recess based on the shape of the part not included in the printing part of the object to be printed is possible.

With this, the object to be printed can be positioned in the jig with high accuracy without affecting the printing.

In the above described printing method of the present invention, the positioning of the object to be printed that is performed in the placement step is possible based on the placement recess that corresponds to the concave-convex shape formed on the opposite surface of the three-dimensional surface of the object to be printed, and shape of the outer peripheral edge of the concave-convex shape.

Therefore, even if the contour shape of the object to be printed is circular, it is possible to position with high accuracy without spoiling the aesthetic appearance of the surface with the printing part of the object to be printed.

According to the present invention with the configuration described above, full-color printing that is fast, detailed, and highly accurate at a low printing cost on a three-dimensional surface of the object to be printed becomes possible.

DETAILED DESCRIPTION

Figure 1:
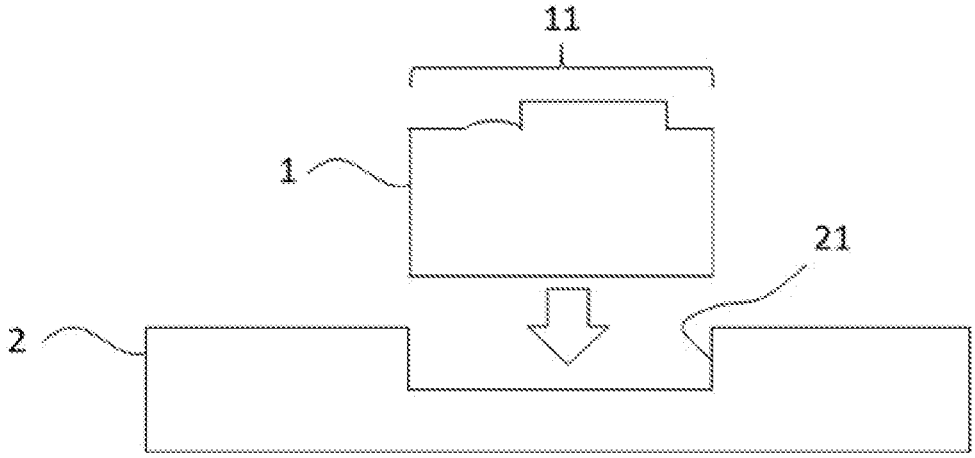
FIG. 1 Figure showing the schematic drawing for the placement step of the printing method according to the embodiment of the present invention.

The embodiment of the present invention will be explained in detail with reference to the accompanying drawings. FIG. 1 shows the schematic drawing for the placement step of the printing method according to the embodiment of the present invention. The printing method according to the embodiment of the present invention assumes that the object to be printed is a decorative item 1 having a regular hexagonal shape in the plan view (See FIG. 5).

The decorative item 1 has a printing part 11 on its upper surface. The printing part 11, is the three-dimensional surface covering the entire top surface (The entire surface of the paper surface of FIG. 1). of the decorative item 1.

In the printing method according to the present embodiment, first, three-dimensional shape of the decorative item 1 which is the object to be printed including the printing part 11, and position of the printing part 11 will be analyzed and converted to two-dimensional data. This conversion to the two-dimensional data is performed by a control unit (Not shown in the figure) of the printer. The conversion to two-dimensional data is performed by taking into consideration the variation in the coating thickness when the three-dimensional shape is flattened based on the three-dimensional shape of decorative item 1 and position of the printing part 11 (Analysis step). The two-dimensional data obtained will not be the same as the plan view of the printing part 11 of decorative item 1, and will be data showing the distorted shape of the shape.

Next, as shown in FIG. 1, after the analysis step, the decorative item 1 is placed in the placement recess 21 of jig 2 having a shape that corresponds to decorative item 1, with the three-dimensional surface to be painted facing upwards (Placement step). Placement recess 21 is of a hexagonal shape that corresponds to the base of decorative item 1, and positioning in the placement recess 21 takes place based on the shape of the base. Since the location required for positioning is the peripheral part of the decorative item 1 that is different from the printing part 11 of the decorative item 1, the object to be printed which is decorative item 1 can be positioned in jig 2 with high accuracy without affecting the printing. There is no restriction on the quantity of decorative item 1 that can be placed in jig 2 with the placement step of the present invention, and the number will vary depending on the quantity of jig 2. In this embodiment, jig 2 that can hold a total of 30 numbers of decorative item 1, arranged 5 vertically and 6 horizontally is used (See FIG. 5).

A clearance of 0.02 mm is provided between the peripheral parts of placement recess 21 and decorative item 1. By providing this clearance, in addition to easy placement of decorative item 1 in placement recess 21, it becomes possible to prevent the occurrence of coating misalignment due to the positional deviation of decorative item 1.

Figure 2:
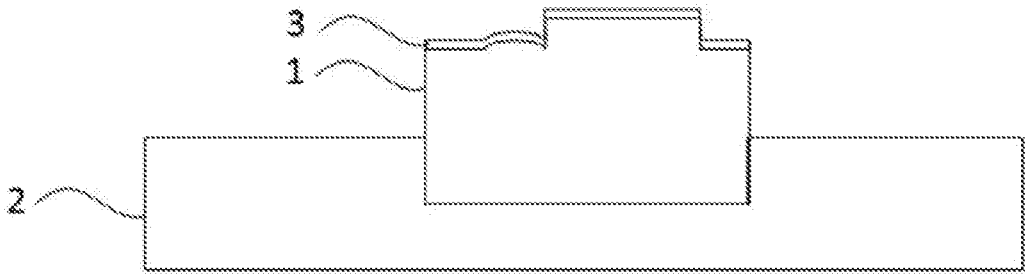
FIG. 2 Figure showing the schematic drawing for the primer layer formation step of the printing method according to the embodiment of the present invention.

FIG. 2 shows the schematic drawing for the primer layer formation step of the printing method according to the embodiment of the present invention. Next, as shown in FIG. 2, primer layer 3 is formed on the printing part 11 of the three-dimensional surface of the decorative item placed in the placement recess 21 (Primer layer formation step).

A mixture (primer) of toluene, xylene, and ethylbenzene is used as the material for primer layer 3 formed in the primer layer formation step, and thickness of primer layer 3 is 5 to 10 μm.

The coating of primer layer 3 is performed by the operation of the printing head (Not shown in the figure) of the printer in the main scanning direction and the sub operation direction with respect to the printing part 11. By forming the primer layer 3, it becomes possible to form the white UV curable ink layer 4, described below, on the primer layer.

Figure 3:
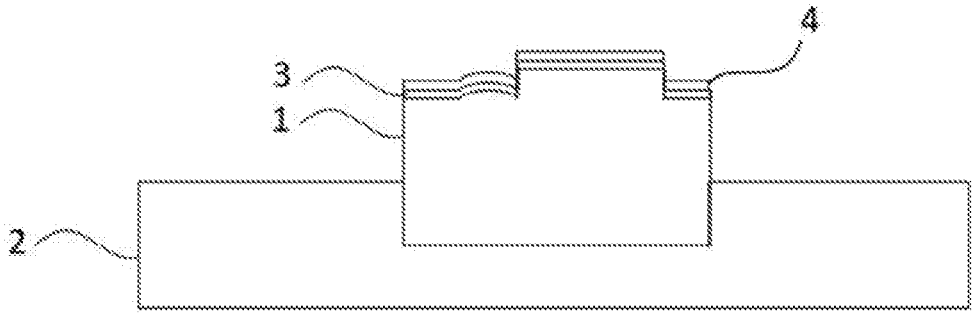
FIG. 3 Figure showing the schematic drawing for the white color coating step of the printing method according to the embodiment of the present invention.

FIG. 3 shows the schematic drawing for the white color coating step of the printing method according to the embodiment of the present invention. Next, the white UV curable ink is coated based on the two-dimensional data on the printing part surface of the primer layer 3 to form the white UV curable ink layer 4, then instantaneous UV irradiation from an LED light source is irradiated on the white UV curable ink layer 4, the white UV curable ink layer 4 hardens, and the so called white color coating is performed (White color coating step).

Known white inks having UV curability can be suitably used as the white UV curable ink. The white color coating step is performed by moving the printing head (Not shown in the figure) of the printer in the main scanning direction and the sub operation direction to coat the white UV curable ink, and then UV irradiation is performed on the parts coated with the white UV curable ink by moving the UV irradiation device (Not shown in the figure) in the main scanning direction and the sub operation direction. UV irradiation is carried out at room temperature for several milliseconds to several seconds.

Figure 4:
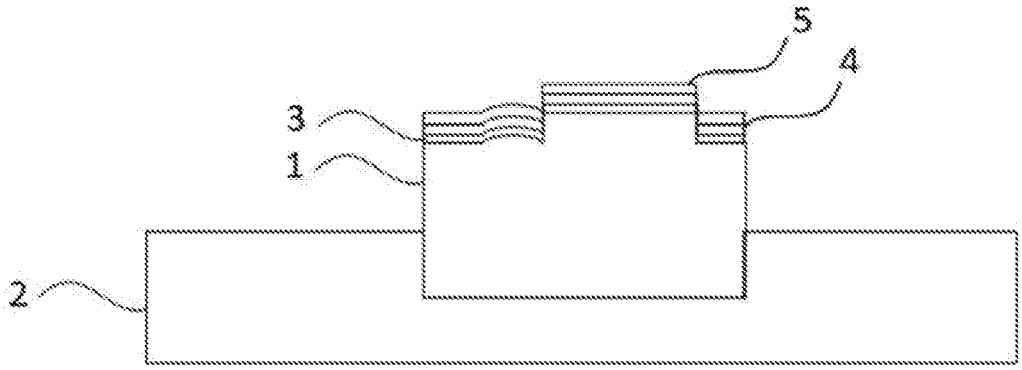
FIG. 4 Figure showing the schematic drawing for the color printing step of the printing method according to the embodiment of the present invention.

FIG. 4 shows the schematic drawing for the color printing step of the printing method according to the embodiment of the present invention. Next, the color ink layer 5 is formed by coating UV curable ink other than white on the printing part where the white UV curable ink layer 4 has been formed based on the two-dimensional data, and then instantaneous UV irradiation from an LED light source is irradiated on the color ink layer 5 to harden the color ink layer 5 (color printing step).

Known color inks having UV curability can be suitably used as color inks. The color printing step is performed by coating the color ink on the white UV curable ink layer 4 that is the printing part with movement of the printing head of the printer in the main scanning direction and the sub operation direction, and by UV irradiation of the coated locations with movement of the UV irradiation device in the main scanning direction and the sub operation direction. UV irradiation is carried out at room temperature for several milliseconds to several seconds. In particular, it is preferable to use yellow, magenta, cyan, and black UV curable inks as the color ink. This makes it possible to perform full-color printing with high accuracy.

According to the printing method of the above embodiment, since primer layer 3, white UV curable ink layer 4 and color ink layer 5 using UV curable ink are formed based on the two-dimensional data obtained by the analysis of the three-dimensional surface shape of the printing part and position of the printing part, full-color printing that is fast, detailed, and highly accurate at a low printing cost on a three-dimensional surface of the object to be printed becomes possible.

In the above described embodiment, a decorative item 1 having a regular hexagonal shape in the plan view was assumed as the object to be printed, the present invention is not limited to this shape and decorative items of other shapes can also be printed.

Figure 5:
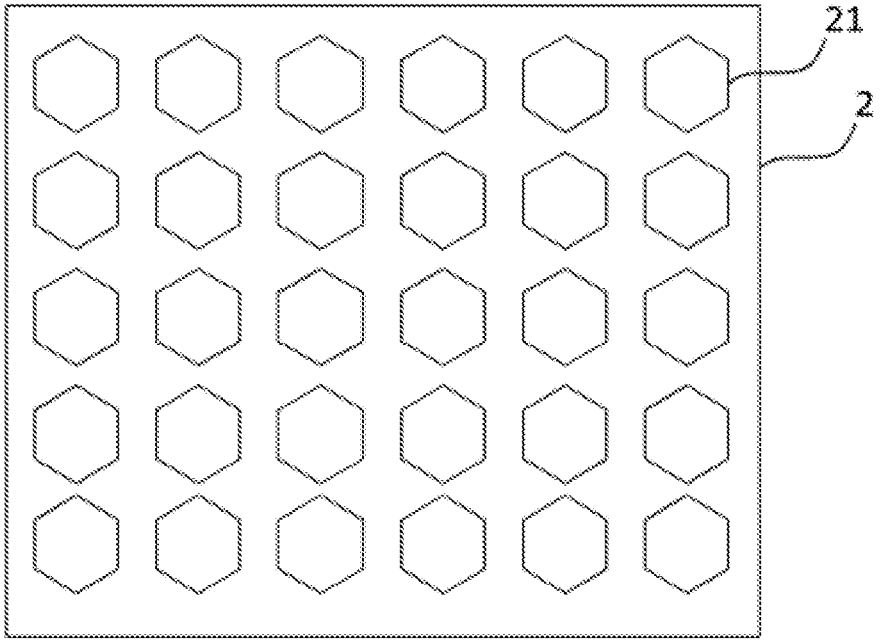
FIG. 5 Figure showing the plan view of an example for the jig shape used for the printing method according to the embodiment of the present invention.

The positioning of decorative item 1 with respect to jig 2 is explained in detail. FIG. 5 shows the plan view of the shape of jig 2 used for the printing method according to the embodiment of the present invention. If the shape of the decorative item 1 has a regular hexagonal shape in the plan view, as shown in FIG. 5, placement recess 21 of jig 2 is also shaped like a regular hexagonal. In this case, positioning is performed by visual confirmation of the placement direction when placing the decorative item 1 with regular hexagon shape in placement recess 21. Therefore, in all steps following the placement step, it is possible to suppress the occurrence of positional deviation as the decorative item 1 is positioned in placement recess 21 and does not rotate. The print head moves along the row or column of jig 2. Multiple decorative item 1 that is fixed in jig 2 can be printed with high speed and accuracy in row units or column units.

On the other hand, if the shape of the decorative item 1 is circular in the plan view, then positioning in placement recess 21 which is circular in shape by visual placement is difficult. In such cases, the decorative item 1 can be positioned in jig 2 by providing a protrusion or concave part on the lower surface of decorative item 1 for positioning and a corresponding concave part or protrusion for positioning in the placement recess 21 of jig 2.

Figure 6:
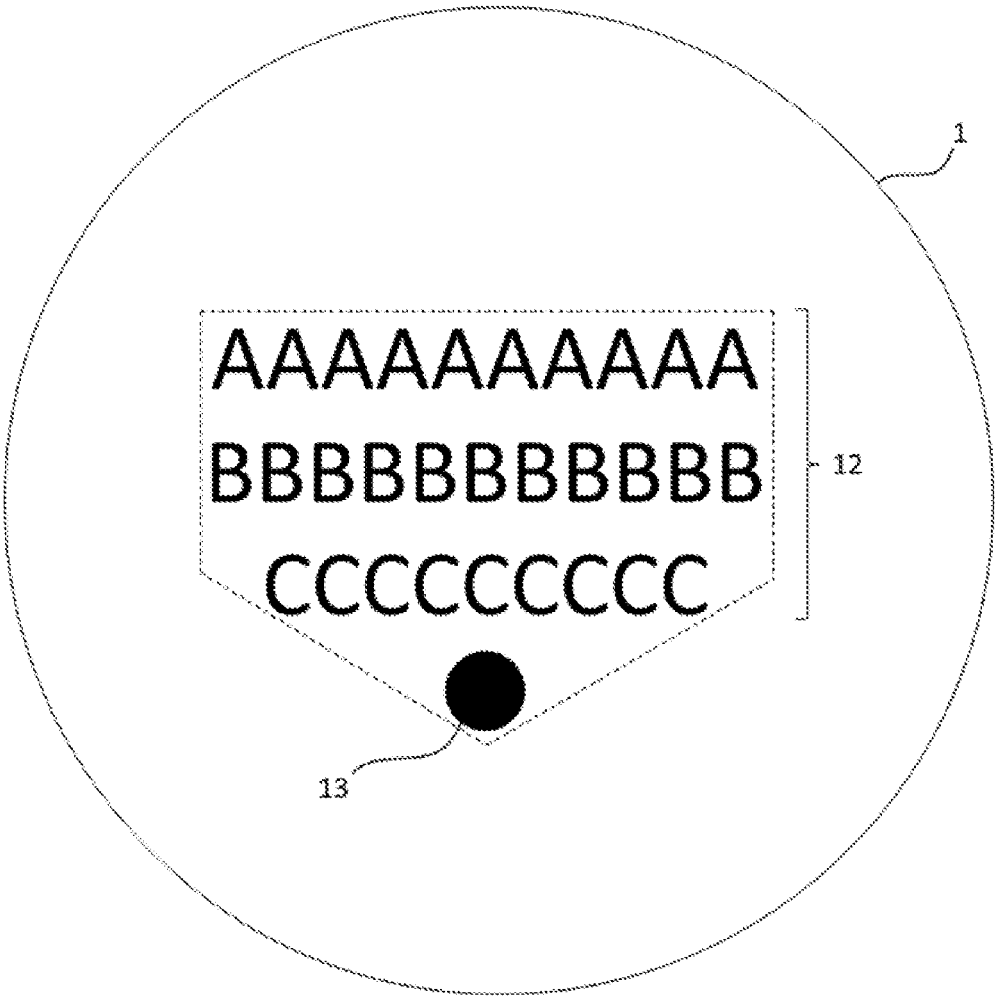
FIG. 6 Figure showing the rear view of an example of the shape for the opposite surface of the object to be printed according to the embodiment of the present invention.
Figure 7:
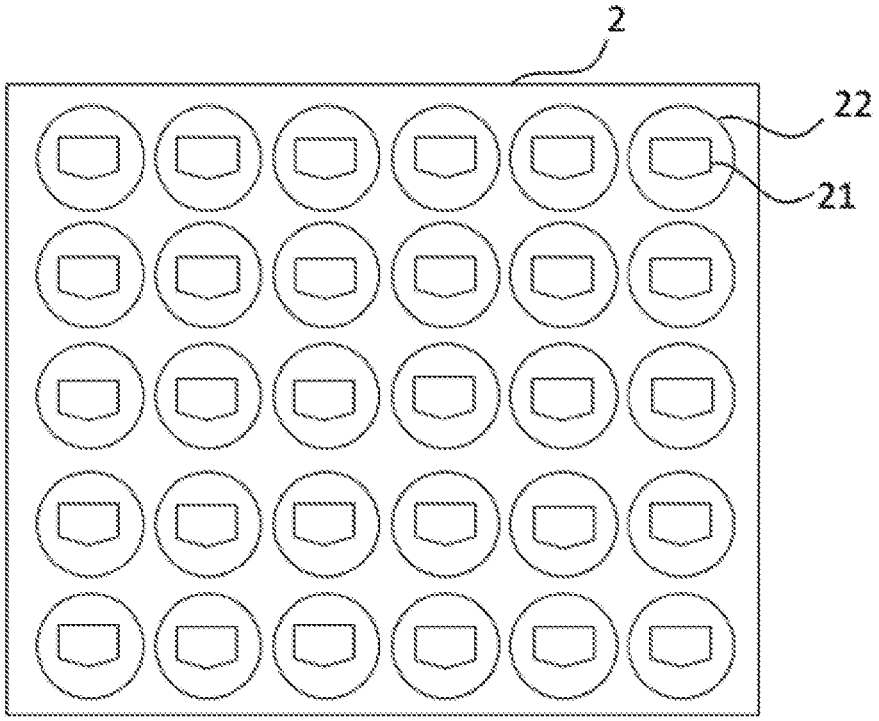
FIG. 7 Figure showing the plan view of the shape of the jig on which the object to be printed of FIG. 6 is placed.

FIG. 6 shows the rear view of an example of the shape for the opposite surface of the object to be printed 1 according to the embodiment of the present invention. FIG. 7 shows the plan view of the shape of jig 2 on which the object to be printed 1 of FIG. 6 is placed. When the shape of the object to be printed 1 is circular in the plan view, for example, a raised character part 12 and a circular protrusion 13 are formed on the reverse surface. Specifically, character part 12 is formed by a row of 11 B characters which is arranged under the row of 10 A characters and a row of 9 C characters which is arranged under the row of B characters. The length of the A and B rows are the same, and the C row is less than the A and B rows. A circular protrusion 13 is formed below row C near the middle position of row C. The peripheral edges of the character part 12 and protrusion 13, as shown by the dashed line in FIG. 6 has a pentagonal shape.

Further, placement recess 21 of jig 2 is formed in a pentagonal shape in the plan view so that character part 12 and protrusion 13 can be placed such that decorative item 1 cannot be rotate after the placement. The decorative item 1 can be positioned by fitting character part 12 and protrusion 13 in the placement recess 21 that has been formed as described. As shown in FIG. 7, a circular reference line 22 is provided in jig 2 that corresponds to the outer periphery of the circular shape of decorative item 1 as a reference for positioning, this enables the approximate positioning of the decorative item 1 in jig 2, and makes the fitting of the character part 12 and protrusion 13 in the placement recess 21 even more easy.

In this way, if the decorative item 1 is circular in the plan view, by providing a concave-convex shape on the opposite surface of the printing part of decorative item 1, and placement recess 21 with a shape corresponding to the outer peripheral edge of the concave-convex shape, to fit the concave-convex shape into jig 2, positioning with high accuracy is possible without spoiling the aesthetic appearance of the surface with the printing part of the object to be printed even if the contour shape of the object to be printed is circular. That is, although characters are displayed on the reverse surface of decorative item 1, guides are not provided (Protrusions having the same shape as placement recess 21) for fitting in placement recess 21. As a result, even if the contour shape of the object to be printed is circular, it is possible to position with high accuracy without spoiling the aesthetic appearance of the surface with the printing part of the object to be printed.

In the above described embodiment, the complete upper surface of the object to be printed was the printing part, however, the present invention is not limited to this, and only a part of the upper surface of the object to be printed can be set as the printing part.

EXPLANATION OF THE REFERENCE NUMERALS

1 Decorative item (Object to be printed)
2 Jig
3 Primer layer
4 White UV curable ink layer
5 Color ink layer
11 Printing part
12 Character part
13 Protrusion
21 Placement recess
22 Reference line

What is claimed is:

1. A printing method comprising the steps of:

an analysis step, where a three-dimensional shape of an object to be printed of which surface is three-dimensional including a printing part and of which shape is circular in a plan view is converted to two-dimensional data that shows a planarized shape of the three-dimensional shape of the object to be printed, based on a shape of the three-dimensional surface and a position of the printing part of the object to be printed, taking into consideration a variation in coating thickness when planarized;

a placement step, where at least a part of the object to be printed is fitted into a placement recess of a jig, and the object to be printed is placed in the jig with the three-dimensional surface facing upward;

a primer layer formation step, where a primer layer is formed on the printing part of the three-dimensional surface based on the two-dimensional data;

a white color coating step, where UV irradiation is performed after coating white UV curable ink on the printing part of the primer layer surface based on the two-dimensional data;

a color printing step, where UV irradiation is performed after coating UV curable inks other than the white UV curable ink on the printing part coated with the white UV curable ink based on the two-dimensional data;

wherein a positioning of the object to be printed in the placement step is performed based on a circular reference line provided on the jig, a character part formed on the reverse side of the three-dimensional surface by arranging plural convex characters in rows and/or columns, and the placement recess corresponding to a shape of an outer periphery of the character part, and wherein the shape of the outer periphery of the character part and the shape of the placement recess are polygonal.

2. The printing method of claim 1, wherein the UV curable inks coated in the color printing step comprises at least one of yellow, magenta, cyan, and black UV curable inks.

3. The printing method of claim 1, wherein the positioning into the placement recess in the placement step is conducted based on a shape of a part not included in the printing part of the object to be printed.

* * * * *